US006702432B2

(12) United States Patent
Takahagi et al.

(10) Patent No.: US 6,702,432 B2
(45) Date of Patent: Mar. 9, 2004

(54) CONFIGURATION OF INKJET HEAD REALIZING UNIFORM INK EJECTION PERFORMANCE

(75) Inventors: Hiroshi Takahagi, Hitachinaka (JP); Nobuhiro Noto, Hitachinaka (JP); Takashi Sato, Hitachinaka (JP); Akira Kashimura, Hitachinaka (JP); Kenji Yamada, Hitachinaka (JP); Kenichi Kugai, Hitachinaka (JP)

(73) Assignee: Hitachi Printing Solutions, Ltd., Kanagawa-ken (JP)

( * ) Notice: Subject to any disclaimer, the term of this patent is extended or adjusted under 35 U.S.C. 154(b) by 0 days.

(21) Appl. No.: 10/140,077

(22) Filed: May 8, 2002

(65) Prior Publication Data

US 2002/0171715 A1 Nov. 21, 2002

(30) Foreign Application Priority Data

May 18, 2001 (JP) ..... P2001-148872

(51) Int. Cl.[7] ..... B41J 2/045
(52) U.S. Cl. ..... 347/70
(58) Field of Search ..... 347/54, 68–72; 310/324, 328; 29/25.35, 890.1

(56) References Cited

U.S. PATENT DOCUMENTS

| | | | | |
|---|---|---|---|---|
| 5,831,651 | A * | 11/1998 | Usui et al. | 347/70 |
| 5,912,526 | A * | 6/1999 | Okawa et al. | 347/72 |
| 5,988,799 | A * | 11/1999 | Abe et al. | 347/68 |
| 6,382,781 | B2 * | 5/2002 | Furuhata et al. | 347/68 |
| 6,488,367 | B1 * | 12/2002 | Debesis et al. | 347/70 |
| 6,530,652 | B1 * | 3/2003 | Kim et al. | 347/70 |

* cited by examiner

*Primary Examiner*—Stephen D. Meier
*Assistant Examiner*—An H. Do
(74) *Attorney, Agent, or Firm*—Whitham, Curtis & Christofferson, P.C.

(57) ABSTRACT

An inkjet head 100 includes a pair of support plates 17A, 17B and a diaphragm plate 9 interposed between the support plates 17A, 17B. In this configuration, even when adhesion between the diaphragm plate 9 and the support plate 17B is insecure, and when a piezoelectric element 12 deforms a diaphragm 7 toward a pressure chamber 3, that is, in a direction away from the support plate 17B, the support plate 17A prevents the diaphragm plate 9 from peeling off the support plate 17B. Accordingly, the dimension and thus a deforming amount of the diaphragm 7 is maintained uniform, whereby a uniform ink ejection performance is maintained.

19 Claims, 6 Drawing Sheets

CONFIGURATION OF INKJET HEAD REALIZING UNIFORM INK EJECTION PERFORMANCE

BACKGROUND OF THE INVENTION

1. Field of the Invention

The present invention relates to an inkjet head for an office and industrial use.

2. Related Art

FIG. 1 is a cross-sectional view of a conventional inkjet head 200. As shown in FIG. 1, the inkjet head 200 includes an orifice plate 2, a chamber plate 4, a restrictor plate 6, a diaphragm plate 9, a support plate 17, and a housing 11, which are all fixed one on the other in this order by adhesive. The inkjet head 200 further includes a plurality of laminated-type piezoelectric elements 12 and a fixing plate 13 for supporting the piezoelectric elements 12.

As shown in FIGS. 1 to 3, the orifice plate 2 is formed with a plurality of nozzles 1 through which ink droplets are ejected. The chamber plate 4 is formed with a plurality of pressure chambers 3 in fluid communication with the corresponding nozzles 1. The restrictor plate 6 is formed with a plurality of restrictors 5 that regulate ink flow toward the pressure chambers 3. The diaphragm plate 9 is integrally formed with a filter 8. The support plate 17 is formed with a plurality of through holes 10A and 10B larger than a cross-sectional dimension of the piezoelectric element 12.

The housing 11 is formed with a common ink chamber 16 and an opening 18. The common ink chamber 16 is in fluid communication with all the restrictors 5 via the through holes 10B and the filter 8. The opening 18 is greater than a cross-sectional dimension of the fixing plate 13. A pair of positioning holes 14 are formed through all the orifice plate 2, the chamber plate 4, the restrictor plate 6, the diaphragm plate 9, the support plate 17, and the housing 11 for positioning these members when manufacturing the inkjet head 200. Adhesive agent or the like (not shown) is filled in the positioning holes 14 to fix the members.

As shown in FIG. 2, portions of the diaphragm plate 9 corresponding to the through holes 10A formed in the support plate 17 serve as diaphragms 7. Each piezoelectric element 12 is attached to the corresponding diaphragm 7 through the through hole 10A such that the piezoelectric element 12 confronts the pressure chamber 3 via the diaphragm 7.

In this configuration, ink inside the common ink chamber 16 is distributed to the restrictors 5 and supplied into the pressure chambers 3. Upon application of a driving voltage, the piezoelectric element 12 causes displacement in the diaphragm 7, which in turn decreases the volume of the corresponding pressure chamber 3 with a resultant increase in the internal pressure thereof. This internal pressure ejects ink inside the pressure chamber 3 as an ink droplet through the nozzle 1.

SUMMARY OF THE INVENTION

However, in the above configuration, when the inkjet head 200 is produced by adhering all the plates 2, 4, 6, 9, 17 at the same time, and adhered portion 9*e* of the diaphragm plate 9 (FIG. 4) is not securely adhered to the support plate 17 for the reason that a uniform pressing force is not applied to the adhered portion 9*e* in a direction indicated by an arrow in FIG. 4 due to the restrictor 5 located adjacent to the adhered portion 9*e*. Accordingly, there is a danger that the diaphragm plate 9 is adhered to, for example, only a region between points P2 and P3 of the support plate 17, although the diaphragm plate 9 must be adhered to a region between points P1 and P3. This changes a fixed end of the diaphragm from the original point P1 to the point P2, changing the dimension of the diaphragm 7. Unevenness in the position of the fixed ends of the diaphragms 7 varies the deforming amount of the diaphragms 7, and changes ink ejection performance of the nozzles 1, whereby overall ink ejection performance of the inkjet head 200 is degraded.

Further, if adhesion between the adhered portion 9*e* and the support plate 17 is insecure, when the piezoelectric element 12 deforms the diaphragm 7 in response to a driving voltage, the adhered portion 9*e* will be easily peeled off the support plate 17, further shifting the fixed end of the diaphragm 7 over a long time use.

It is an object of the present invention to overcome the above problems, and to provide an inkjet head realizing a uniform ink ejection performance.

In order to overcome the above and other object, there is provided an inkjet head including a diaphragm plate having a first surface and a second surface, a piezoelectric element attached to the first surface of the diaphragm plate for selectively deforming the diaphragm plate, a support plate attached to the second surface of the diaphragm plate and formed a first through hole and a second through hole, and a channel plate attached to the support plate in a manner that the support plate is interposed between the channel plate and the diaphragm plate, the channel plate being formed with a channel fluidly connecting the first through hole and the second through hole.

There is also provided an inkjet head including a pair of support plates formed with a through hole, a diaphragm plate interposed between and attached to the pair of support plates, and a piezoelectric element attached to the diaphragm through the through hole formed in one of the support plates. The support plates are substantially identical.

Further, there is provided an inkjet head including a support plate, a diaphragm plate, and a piezoelectric element. The support plate is formed with a through hole. The diaphragm plate is attached to the support plate. A portion of the diaphragm plate corresponding to the through hole serves as a diaphragm. The diaphragm has a first surface confronting the through hole and a second surface opposite to the first surface. The piezoelectric element is attached to the second surface of the diaphragm for selectively deforming the diaphragm.

PREFERRED EMBODIMENT OF THE PRESENT INVENTION

Next, inkjet heads according to preferred embodiments of the present invention will be described while referring to the attached drawings.

First, an inkjet head 100 according to a first embodiment of the present invention will be described. Components same as those of the above-described conventional inkjet head 200 will be assigned with the same numberings and description thereof will be omitted in order to avoid duplication in explanation.

Figure 1:
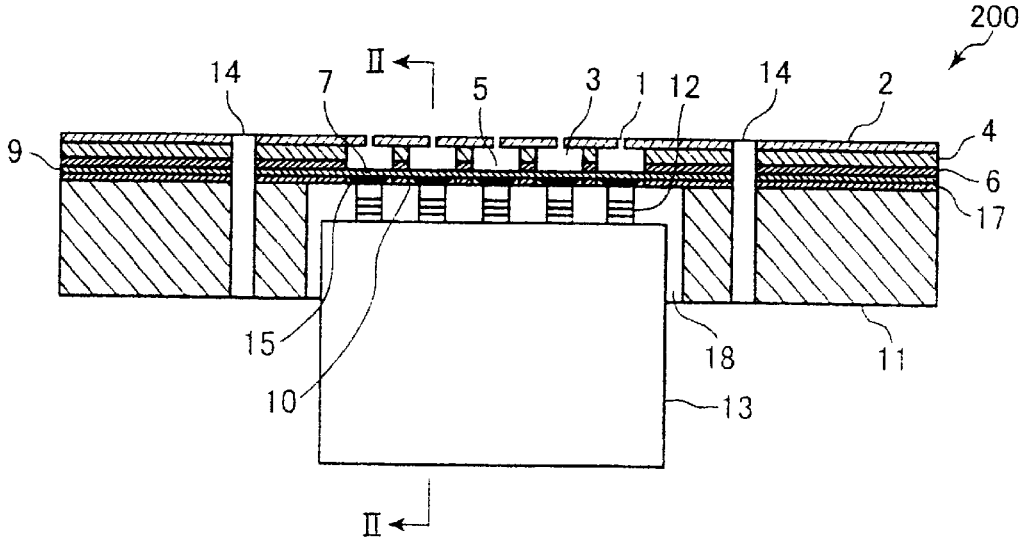
FIG.1 Related Art
FIG. 1 is a cross-sectional view of a conventional inkjet head.
Figure 2:
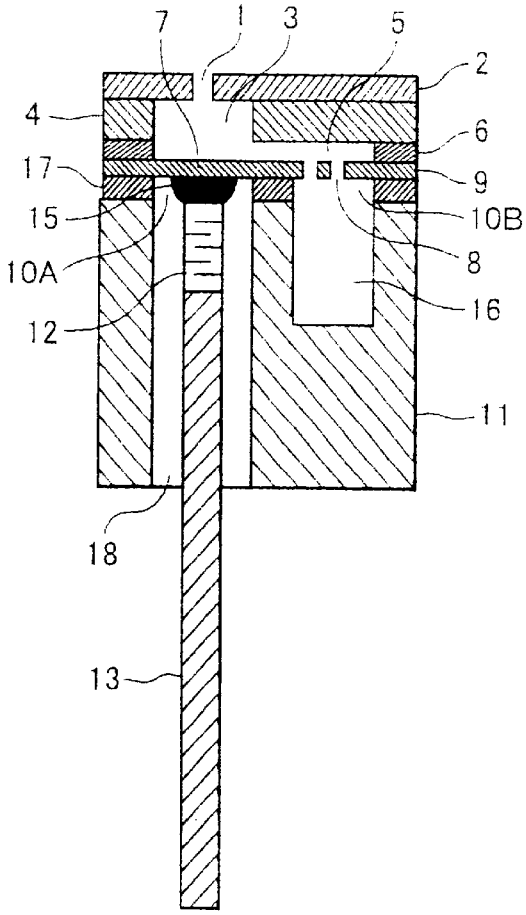
FIG.2 Related Art
FIG. 2 is cross-sectional view of the conventional inkjet head taken along a line II—II of FIG. 1.
Figure 3:
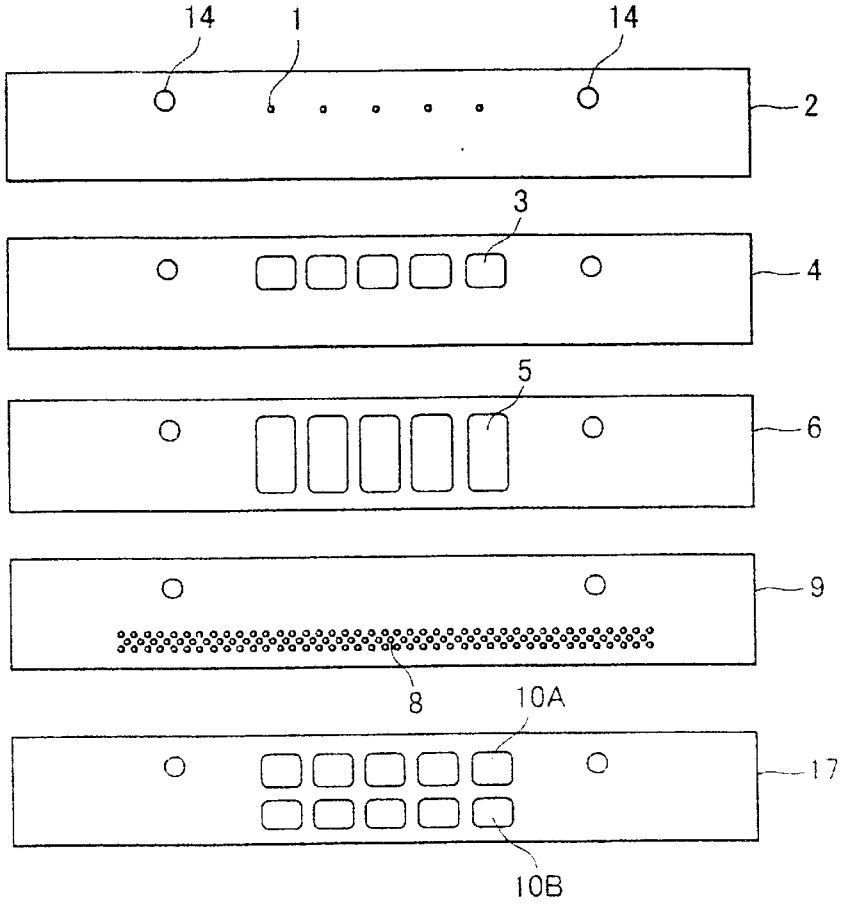
FIG.3 Related Art
FIG. 3 is a plan view showing plates of the conventional inkjet head.
Figure 4:
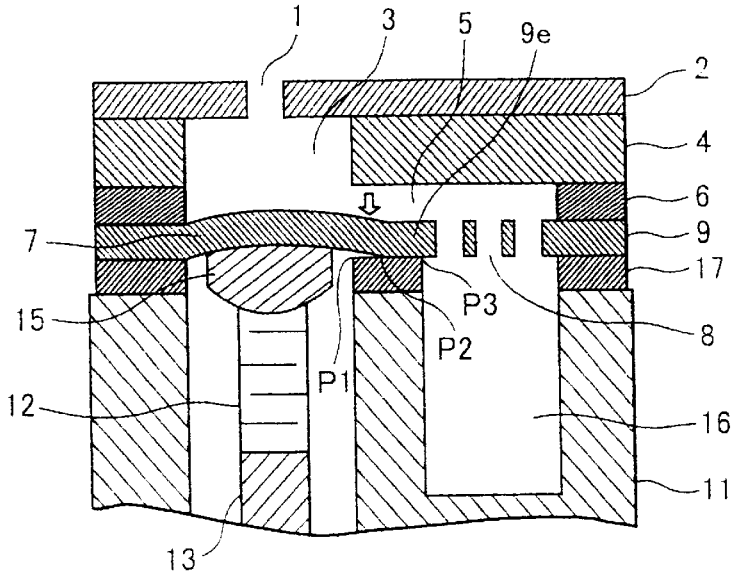
FIG.4 Related Art
FIG. 4 is a cross-sectional view of the conventional inkjet head where a fixed end of a diaphragm is shifted from an original position.
Figure 5:
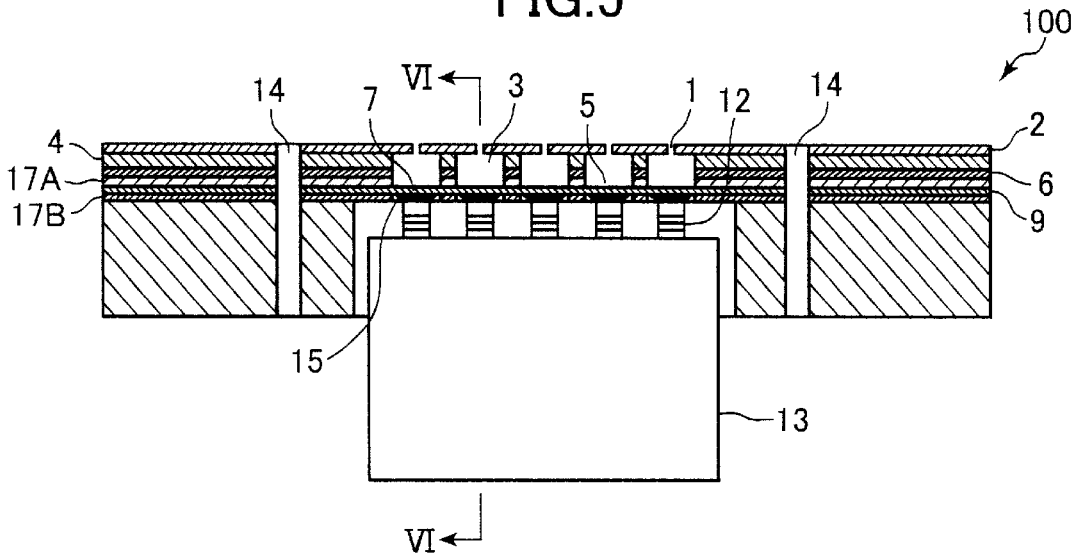
FIG. 5 is a cross-sectional view of an inkjet head according to a first embodiment of the present invention.
Figure 6:
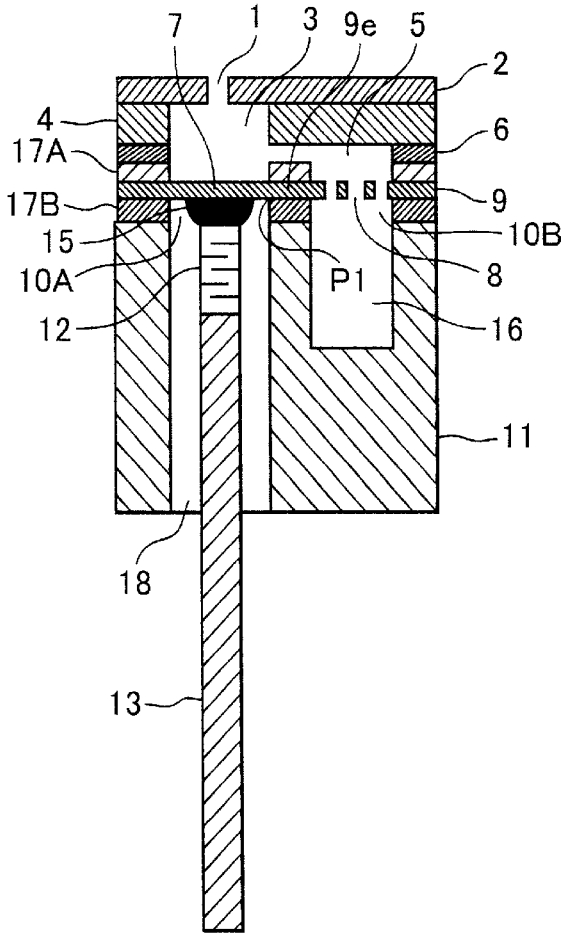
FIG. 6 is a cross-sectional view of the inkjet head taken along a line VI—VI of FIG. 5.
Figure 8:
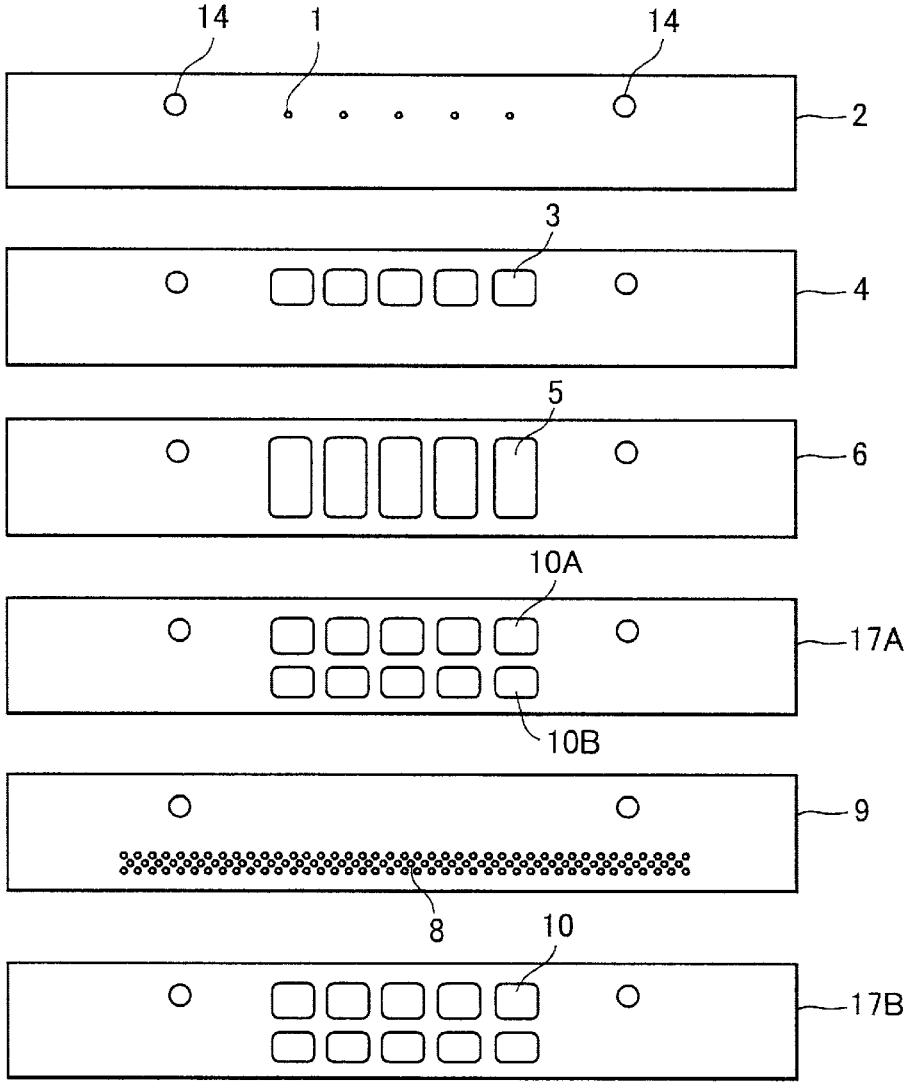
FIG. 8 is a plan view showing plates of the inkjet head of FIG. 5.

As shown in FIGS. 5 and 6, the inkjet head 100 has the similar configuration as that of the conventional inkjet head 200 shown in FIGS. 1 and 2, except that a diaphragm plate 9 of the present embodiment is interposed between a pair of support plates 17A, 17B. The support plates 17A, 17B both have the same configuration as the support plate 17 of the conventional inkjet head 200 and are, as shown in FIG. 8, formed with a plurality of through holes 10A, 10B and a pair of positioning holes 14.

Figure 7:
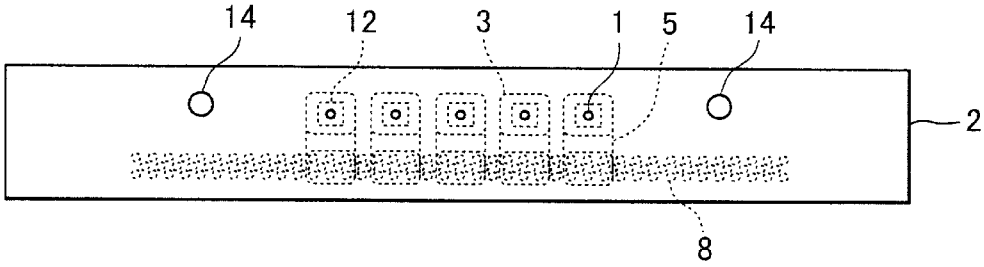
FIG. 7 is an explanatory phantom view showing positional relationship among components of the inkjet head.

Here, as shown in FIG. 7, the nozzle 1, the pressure chamber 5, and the piezoelectric element 12, i.e., the diaphragm 7, are all in alignment in a direction in which the plates 2, 4, 6, 17A, 9, 17B are laminated.

In the above configuration, because the adhered portion 9*e* of the diaphragm plate 9 is sandwiched between the support plates 17A and 17B, the rigidity of the diaphragm plate 9, i.e., the adhered portion 9*e* increases with a resultant improvement in adhesion between the adhered portion 9*e* and the support plate 17B. Also, even if the adhesion between the adhered portion 9*e* and the support plate 17B is insecure, the support plate 17A prevents the adhered portion 9*e* from peeling off the support plate 17B. Accordingly, the fixed end of the diaphragm 7 is maintained at the original position P1.

Moreover, even when the piezoelectric element 12 deforms the diaphragm 7 toward the pressure chamber 3, that is, in a direction toward the support plate 17A and away from the support plate 17B, in response to a driving voltage for ejecting an ink droplet, the support plate 17A prevents the adhered portion 9*e* from peeling off the support plate 17B, and an edge of the support plate 17A defining the through hole 10A positions the fixed end in place at the original position P1. Accordingly, the deforming amount of the diaphragm 7 is maintained the same, realizing a uniform ink ejection performance over a long time use.

The inkjet head 100 having the above configuration is formed in the following manner. That is, first, the diaphragm plate 9 is positioned between and fixedly adhered to the support plates 17A and 17B. The relative position of the diaphragm plate 9 with respect to the support plates 17A and 17B is determined using the positioning holes 14. Then, the rest of the plates 2, 4, 6 and the housing 11 are fixedly adhered to one on the other and also to the support plates 17A and 17B. By fixing the diaphragm plate 9 to the support plates 17A and 17B first, the fixing operation is facilitated, and the diaphragm plate 9 is securely fixed to the support plates 17A and 17B regardless of the existence of the restrictors 5, which contrasts to the conventional inkjet head 200 where the plate members are all adhered one another at once.

It is preferable that the support plates 17A, 17B be formed by etching or the like in the same production lot so as to minimize variations in dimension of the support plates 17A, 17B. This further suppresses the variations in position of the fixed ends of the diaphragms 7. It is preferable that the support plates 17A and 17B have exactly the same size and the same shape in order to suppress the fluctuation in ink ejection performance. However, the exact-same size and shape are not required.

As described above, according to the present embodiment, the adhered portion 9*e* is prevented from peeling off the support plate 17B, and the fixed end of the diaphragm 7 is maintained at the original position. Accordingly, fluctuation in ink ejection performance is prevented, so that the inkjet head 100 capable of stable ink ejection can be provided.

Next, an inkjet head 100A according to a second embodiment of the present invention will be described while referring to FIGS. 9, 10, and 11. Components that are the same as those of the first embodiment are assigned with the same numberings and their explanation will be omitted in order to above duplication in explanation.

Figure 9:
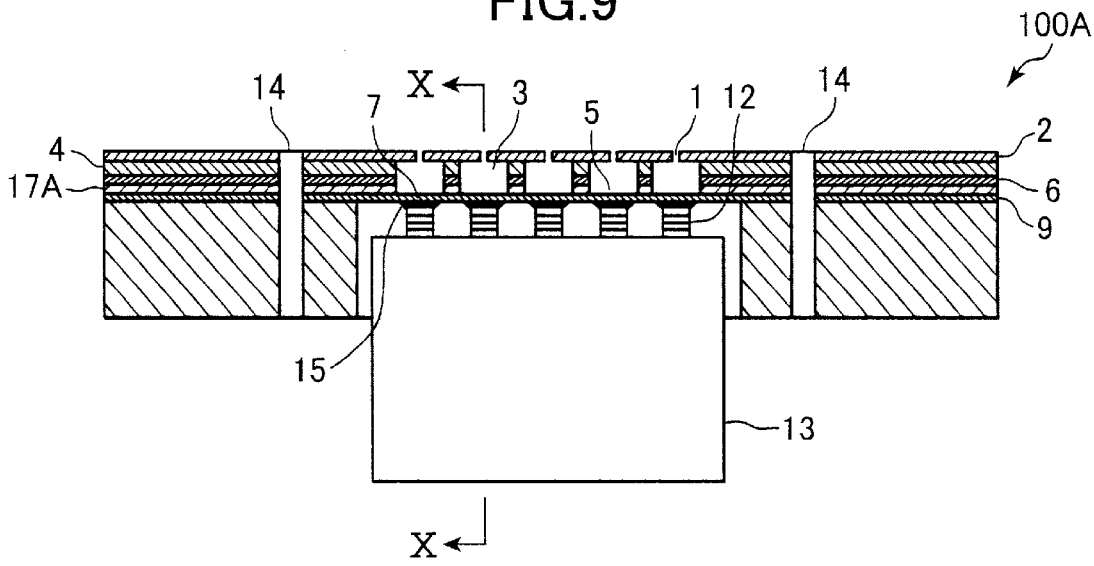
FIG. 9 is a cross-sectional view of an inkjet head according to a second embodiment of the present invention.

As shown in FIG. 9, the inkjet head 100A has the similar configuration as the inkjet head 100 of the first embodiment, except that the support plate 17B is dispensed with in the second embodiment. This configuration also provides the same effect obtained in the configuration of the first embodiment.

Figure 10:
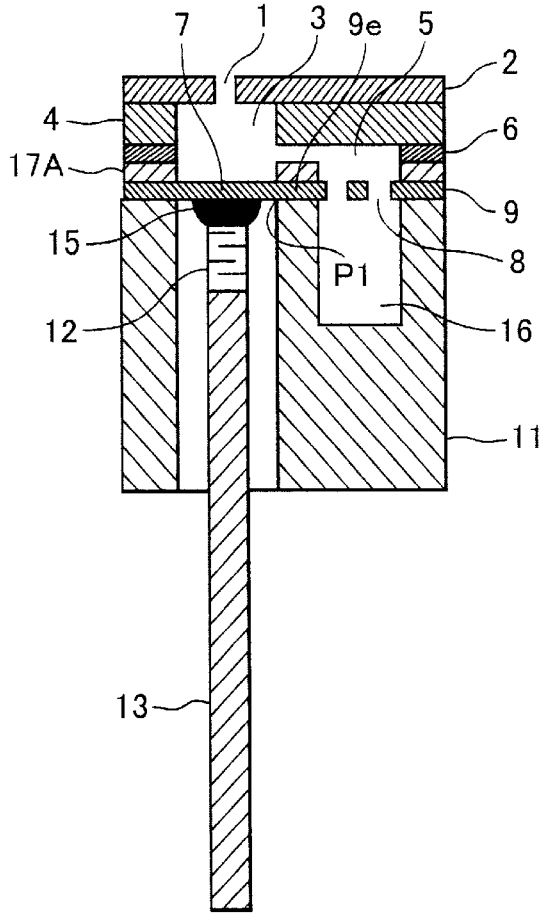
FIG. 10 is a cross-sectional view of the inkjet head taken along a line X—X of FIG. 9.
Figure 11:
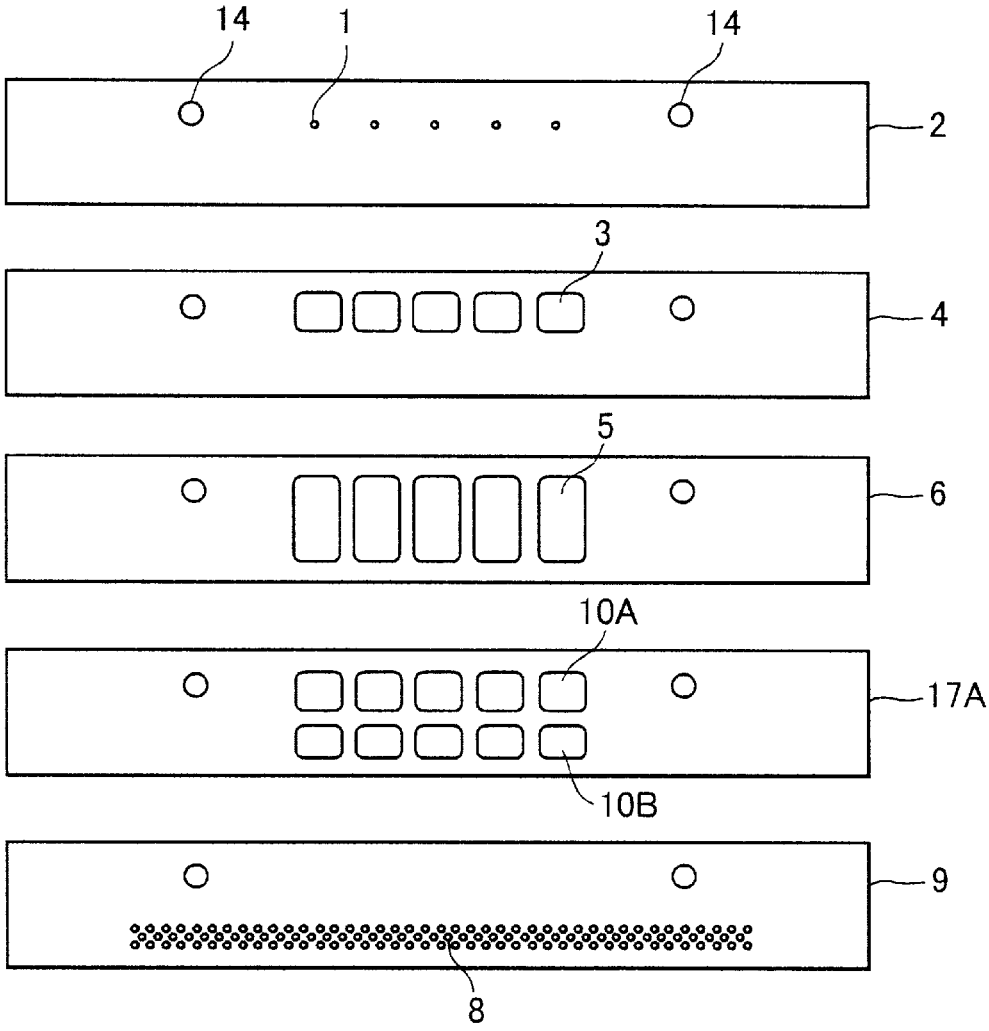
FIG. 11 is a plan view showing plates of the inkjet head of FIG. 9.

That is, as shown in FIG. 10, the adhered portion 9*e* of the diaphragm plate 9 is interposed between and adhered to the support plate 17A and the housing 11. In this configuration, even when the adhesion between the adhered portion 9*e* and the housing 11 is insecure, and even when the piezoelectric element 12 deforms the diaphragm 7 toward the pressure chamber 3, the support plate 17A prevents the adhered portion 9*e* from peeling off the housing 11, thereby maintaining the fixed end of the diaphragm 7 at the original position P1. Therefore, a uniform ink ejection performance is maintained.

In this embodiment also, the diaphragm plate 9 and the support plate 17A are first fixed to each other, and then the rest of the plates and the housing are fixed. In this manner, the diaphragm plate 9 and the support plate 17A are securely fixed in a stable manner, minimizing the variations in position of the fixed end of the diaphragms 7. Hence, the inkjet head 100A capable of uniform ink ejection without undesirable variation can be provided.

While some exemplary embodiments of this invention have been described in detail, those skilled in the art will recognize that there are many possible modifications and variations which may be made in these exemplary embodiments while yet retaining many of the novel features and advantages of the invention.

What is claimed is:

1. An inkjet head comprising:

a diaphragm plate having a first surface and a second surface;

a piezoelectric element attached to the first surface of the diaphragm plate for selectively deforming the diaphragm plate;

a support plate attached to the second surface of the diaphragm plate and formed with a plurality of first through holes and a plurality of second through holes in one-to-one correspondence with the first through holes; and a channel plate attached to the support plate in a manner that the support plate is interposed between the channel plate and the diaphragm plate, the channel plate being formed with a plurality of channels, each fluidly connecting a corresponding one of the first through holes a corresponding one of holes.

2. The inkjet head according to claim 1, wherein the diaphragm plate is formed with a filter confronting the first through hole and an area of the diaphragm plate confronting the second through hole defines a diaphragm.

3. The inkjet head according to claim 2, wherein the piezoelectric element is attached to the diaphragm of the diaphragm plate.

4. The inkjet head according to claim 2, further comprising a housing formed with a common chamber in fluid communication with all of the plurality of first through holes of the support plate via the filter, and a fixing unit that supports the piezoelectric element, wherein the piezoelectric element has a first end and a second end opposite to the first end, the first end being attached to the first surface of the diaphragm plate, the second end being attached to the fixing unit.

5. An inkjet head comprising:

a pair of support plates each formed with a through hole;

a diaphragm plate interposed between and attached to the pair of support plates, the support plates being substantially identical;

a piezoelectric element attached to the diaphragm plate through the through hole formed in one of the support plates; and a channel plate to another one of the support plates such that the another one of the support plates is interposed between the channel plate and the diaphragm plate, the channel plate being formed with a channel.

6. The inkjet head according to claim 5, wherein the channel is a restrictor for restricting ink flow.

7. The inkjet head according to claim 5, further comprising a fixing unit that supports the piezoelectric element, wherein the piezoelectric element has a first end and a second end opposite to the first end, the first end being attached to the diaphragm plate, the second end being attached to the fixing unit.

8. An inkjet head comprising:

a support plate formed with a first through hole;

a diaphragm plate attached to the support plate, wherein a portion of the diaphragm plate corresponding to the first through hole serves as a diaphragm, the diaphragm having a first surface confronting the first through hole and a second surface opposite to the first surface;

a piezoelectric element attached to the second surface of the diaphragm for selectively deforming the diaphragm; and another support plate attached to the diaphragm plate such that the diaphragm plate is interposed between the support plate and the another support plate.

9. The inkjet head according to claim 8, wherein the support plate is formed with a second through hole, and the another support plate is formed with a third through hole located in alignment with the first through hole formed in the support plate and a fourth through hole located in alignment with the second through hole, wherein the diaphragm plate is bonded to the support plate in an area between the first through hole and the second through hole and to the another support plate in an area between the third through hole and the fourth through hole.

10. The inkjet head according to claim 9, further comprising:

a channel plate attached to the support plate, the channel plate being formed with a channel in fluid communication with the first through hole and the second through hole formed in the support plate;

a chamber plate attached to the channel plate, the chamber plate being formed with a pressure chamber in fluid communication with the channel;

an orifice plate attached to the chamber plate, the orifice plate being formed with an orifice in fluid communication with the pressure chamber; and a housing attached to the another support plate, the housing being formed with a hole in alignment with the third through hole formed in the another support plate, wherein the hole of the housing and the third through hole of the another support plate house the piezoelectric element.

11. The inkjet head according to claim 10, wherein the housing is further formed with a common chamber, and the diaphragm plate is integrally formed with a filter in fluid communication with the fourth through hole, and the fourth through hole is in fluid communication with the second through hole via the filter.

12. The inkjet head according to claim 8, wherein the support plate and the another support plate have the same size and the same shape.

13. The inkjet head according to claim 8, further comprising a fixing unit that supports the piezoelectric element, wherein the piezoelectric element has a first end and a second end opposite to the first end, the first end being attached to the second surface of the diaphragm, the second end being attached to the fixing unit.

14. An inkjet head comprising:

a support plate formed with a first through hole;

a diaphragm plate having a first surface and a second surface opposite to the first surface, the first surface being attached to the support plate, wherein a portion of the diaphragm plate corresponding to the first through hole serves as a diaphragm, the diaphragm having a first diaphragm surface confronting the first through hole and a second diaphragm surface opposite to the first diaphragm surface;

a piezoelectric element attached to the second diaphragm surface of the diaphragm for selectively deforming the diaphragm; and a housing attached to the second surface of the diaphragm plate such that the diaphragm plate is interposed between the support plate and the housing.

15. The inkjet head according to claim 14, wherein the support plate is further formed with a second through hole, and the housing is formed with a third hole in alignment with the first through hole formed in the support plate, wherein the piezoelectric element is housed in the third hole, and the diaphragm is attached to the support plate in an area between the first through hole and the second through hole.

16. The inkjet head according to claim 14, further comprising:

a channel plate attached to the support plate, the channel plate being formed with a channel in fluid communication with the first through hole and the second through hole formed in the support plate;

a chamber plate attached to the channel plate, the chamber plate being formed with a pressure chamber in fluid communication with the channel; and an orifice plate attached to the chamber plate, the orifice plate being formed with an orifice in fluid communication with the pressure chamber.

17. The inkjet head according to claim 14, wherein the housing is further formed with a common chamber, and the diaphragm plate is further formed with a filter, through which the common chamber is in fluid communication with the second through hole.

18. The inkjet head according to claim 14, wherein the piezoelectric element deforms the diaphragm toward the support plate.

19. The inkjet head according to claim 14, further comprising a fixing unit that supports the piezoelectric element, wherein the piezoelectric element has a first end and a second end opposite to the first end, the first end being attached to the second diaphragm surface of the diaphragm, the second end being attached to the fixing unit.

* * * * *